United States Patent [19]

Greenlee et al.

[11] 4,109,714

[45] Aug. 29, 1978

[54] SHUTDOWN SYSTEM FOR HIGH PRESSURE WELL

[75] Inventors: Donald Roy Greenlee, Dallas; Milton Wayne Burns, Abilene, both of Tex.

[73] Assignee: Dresser Industries, Inc., Dallas, Tex.

[21] Appl. No.: 825,017

[22] Filed: Aug. 16, 1977

[51] Int. Cl.[2] ..... E21B 43/12

[52] U.S. Cl. ..... 166/53; 137/487; 175/25

[58] Field of Search ..... 166/53, 75, 321, 97; 137/487, 492, 492.5, 102, 488; 175/25

[56] References Cited

U.S. PATENT DOCUMENTS

| | | | |
|---|---|---|---|
| 2,447,408 | 8/1948 | Griswold | 137/487 |
| 2,649,115 | 8/1953 | Deardorff | 137/488 |
| 3,294,111 | 12/1966 | Abercrombie et al. | 137/102 |
| 3,512,560 | 5/1970 | Weise | 137/102 |
| 3,572,359 | 8/1968 | Weise | 137/487 |
| 3,716,074 | 2/1973 | Peters | 137/487 |
| 3,863,714 | 2/1975 | Watson, Jr. | 166/53 |

*Primary Examiner*—Ernest R. Purser
*Attorney, Agent, or Firm*—Richard M. Byron

[57] ABSTRACT

A normally open shutdown system for a high pressure gas well is disclosed which comprises a pressure-operated motor valve, a pressure sensor, and a pressure regulator, all on a conduit installed in the high pressure line leading from the gas well.

6 Claims, 1 Drawing Figure

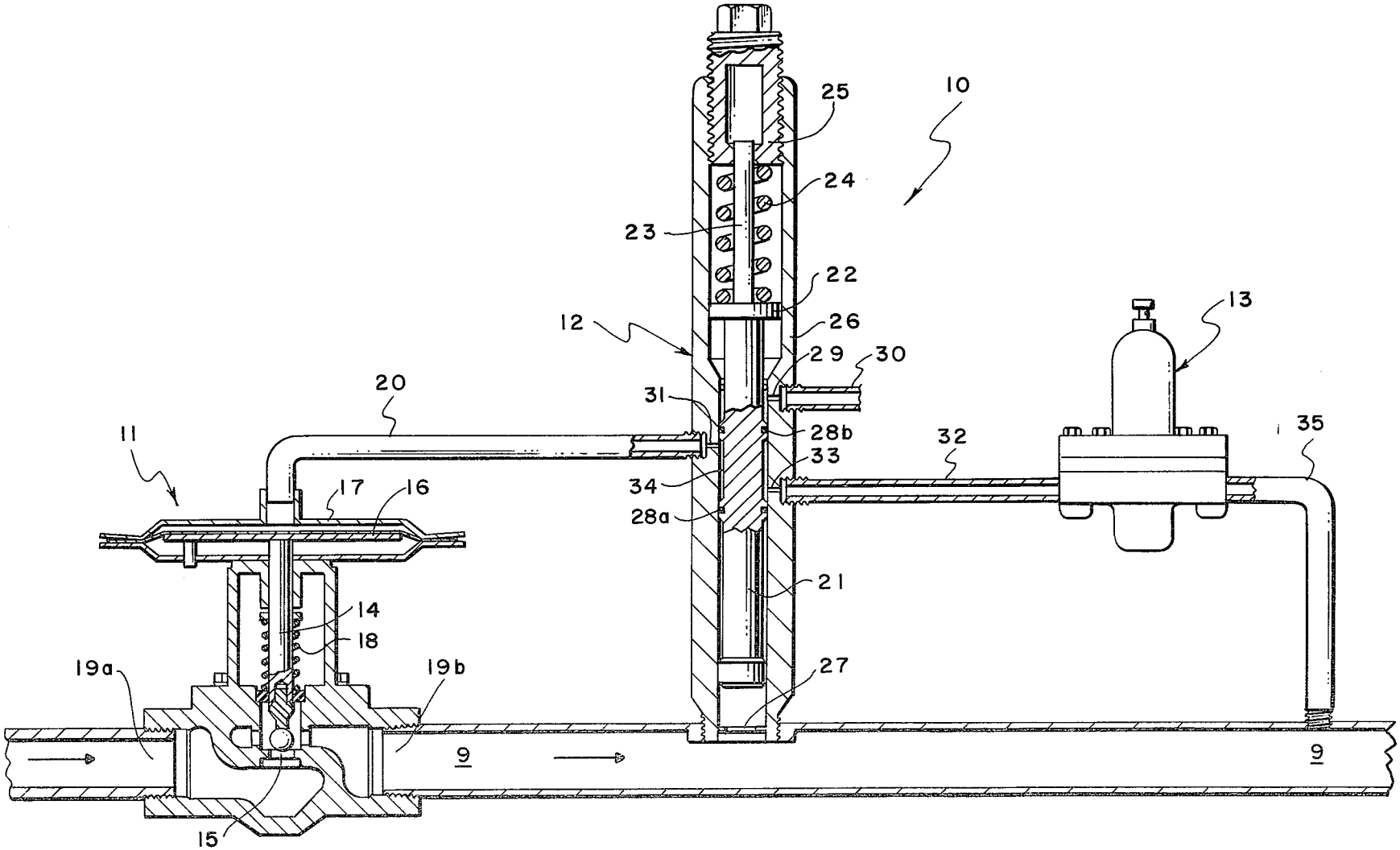
10
11
12
13
14
15
16
17
18
19a
19b
20
21
22
23
24
25
26
27
28a
28b
29
30
31
32
33
34
35
9
9

SHUTDOWN SYSTEM FOR HIGH PRESSURE WELL

BACKGROUND OF THE INVENTION

The present invention generally discloses a safety system for a high pressure gas well and more particularly involves a shutdown system which is "normally open" rather than one that is "normally closed".

Prior art systems currently in use on such wells usually comprise only a pop-off safety valve installed in the flowline from the wellhead. When a pressure surge or build-up occurs in the well and is transmitted to the wellhead, before the pressure can rupture the weaker flowline, it is bled to the atmosphere through the pop-off valve. This protects the flowline from rupturing under high wellhead pressures, but suffers the disadvantage of providing a free vent to atmosphere of explosive and/or toxic gas. Usually this will continue to vent to atmosphere until the well operator returns to the well site and notices the well condition or until the pressure surge dies out.

Other safety systems utilized on gas wells are of the type known as "normally closed" systems. These systems use some parameter of the well operation to maintain a flow valve open against a biasing force continuously urging the flow valve to a closed, non-flow position. If any malfunction occurs in the safety system unrelated to a high pressure surge from the well, the flow valve will close off production from the well even though there is no danger of high pressure blowout in the flowline. Production from the well will be lost to the well owner until the operator notices the shutdown condition and cures the malfunction in the safety system.

The present invention overcomes these disadvantages by providing a safety shutdown system that does not vent free-flowing production gas into the atmosphere nor does it close off production in response to a malfunction occurring in the safety system.

This is accomplished by inserting a motor valve between the wellhead and the flowline, a pressure sensor in the flowline, and an operating pressure line downstream of the sensor, passing through the sensor, and communicating well pressure to operate the motor valve.

BRIEF DESCRIPTION OF THE DRAWING

FIG. 1 is a partial cross-sectional schematic illustration of the system of this invention.

DESCRIPTION OF THE PREFERRED EMBODIMENTS

Referring now to the drawing, a safety shutdown system 10 is illustrated in partial cross-sectional and schematic view. The system generally comprises a motorized valve 11, a pressure sensor 12, and a gas regulator 13.

The motor valve 11 is of the well known and commercially available type using a slidable valve member 14 coacting with a flow port 15, a diaphram plate 16 attached at the upper end of the valve member and located in a pressure activation chamber 17, and a biasing spring 18 tending to bias the valve member 14 upward out of flow port 15.

A pressure conduit 20 is connected to chamber 17 and communicates with pressure sensor 12. Pressure sensor 12 comprises a piston sensor element 21 having a spring abutment plate 22 attached near the top thereof and a spring stem 23 fixed to the top of plate 22. A biasing spring 24 rests atop plate 22 and is in abutment with upper sensor plug 25. Sensor piston 21 is slidably located within the tubular sensor housing 26, which housing has a pressure inlet port 27 communicating with a gas pressure flowline 9.

Likewise, motor valve 11 has an inlet bore **19*a* and an exit bore 19*b* in concentric axial communication with flowline 9. Pressure sensor piston 21 has a lower seal unit 28*a* and an upper seal unit 28*b* located peripherally around the piston. A pressure discharge conduit 30 is connected to the housing and communicates to the interior thereof by means of exit port 29**.

Conduit 30 may lead to a gas accumulation container or other safe disposal means. Likewise, conduit 20 communicates with piston 21 by means of a port 31 formed in the housing.

A third conduit 32 communicates with piston 21 by means of a third housing port 33. The vertical spacing of conduits 20, 30, and 32 is arranged such that at any one time, no more than two of the conduits are in communication with the undersize area 34 on piston 21 located between seals 27 and 28. Conduit 32 is in fluidic communication with gas regulator 13 which in turn is in communication with flowline 9 by means of conduit 35.

In typical operation, the motor valve 11 is arranged in a generally open configuration as illustrated. The biasing spring 18 tends to maintain the valve member 14 a measurable distance above valve flow port 15. Under normal pressure conditions, flow will continuously pass through motor valve 11. Should a pressure surge or even a gradual increase in pressure occur in flowline 9 to the point where the pressure limit of the flowline is being approached, the sensor 12 will react to the increase of pressure by the movement of piston 21 upward thereby allowing the transmission of the pressurized gas from flowline 9 through conduit 35, pressure regulator 13 and conduit 32 into the undersize area 34. This pressure is transmitted through port 31 and conduit 20 to the pressure chamber 17 of motor valve 11.

The resulting pressure influx in chamber 17 acts on plate 16, moving valve member 14 downward against the action of spring 18 and seating valve member 14 in port 15, thereby closing off additional flow through valve 11 into flowline 9.

Upon a reduction in the flowline pressure, the sensor 21 will be moved downward by spring 24 thereby moving upper seal **28*b* between ports 31 and 33 and allowing pressure in chamber 17 to exit through port 29 and conduit 30. This results in an opening of port 15 by the action of spring 18 on member 14. Should the pressure again build-up in flowline 9 to the critical point, piston 21 will again move upward until seal 28*b* passes above port 31 thereby exposing the pressure actuation system of motor valve 11 to the regulated gas pressure from flowline 9 by way of conduits 35, 32, and 20**.

Thus, it can be seen that the present invention provides a normally open safety system which utilizes the internal wellhead pressure to actuate a motorized valve when that pressure reaches a critical predetermined level. The system prevents any discharge of explosive or toxic well gas into the atmosphere and is, in itself, fully self contained without need for external energy sources to actuate the motor valve. Although a specific preferred embodiment of the present invention has been described in the detailed description above, the description is not intended to limit the invention to the particular forms or embodiments disclosed herein since they are to be recognized as illustrative rather than restrictive and it will be obvious to those skilled in the art that the invention is not so limited. Thus, this invention is declared to cover all changes and modifications of the specific example of the invention herein disclosed for purposes of illustration which do not constitute departures from the spirit and scope of the invention.

The embodiments of the invention in which an exclusive property or privilege is claimed are defined as follows:

1. A high pressure well shutdown system for preventing high pressure fluids from entering the flowline of a wellhead, said shutdown system comprising:

a pressure actuated, normally open, flow valve connectable in fluid communication with a well fluid outlet of a wellhead;

a pressure sensor assembly fluidically connectable to a wellhead fluid conduit downstream of said flow valve and having pressure responsive means in fluid communication with said wellhead fluid conduit;

said pressure responsive valve means has a slidable piston having a biasing spring abutting thereon, a lower peripherial seal and an upper peripherial seal defining an undersized flow area around said piston, and a pressure response area at one end of said piston adapted to respond to pressure in said wellhead fluid conduit;

a pressure transmission conduit in fluid communication with the wellhead fluid conduit downstream of said pressure sensor assembly and adapted to transmit fluid pressure from the wellhead fluid conduit through said pressure responsive valve means; and closing pressure conduit means connecting said pressure responsive valve means to said flow valve.

2. The shutdown system of claim 1 further comprising gas regulator means in said transmission conduit for limiting the maximum pressure which can be transmitted through said transmission conduit.

3. The shutdown system of claim 1 wherein said flow valve comprises a pressure motor valve having a pressure responsive diaphragm actuator.

4. The shutdown system of claim 1 further comprising pressure relief means attached to said sensor assembly, arranged to communicate with said valve means, and adapted to relieve accumulated actuation pressure from said flow valve.

5. A gas well high pressure shutdown assembly for interconnection between a wellhead and a flowline, said assembly comprising:

a motor valve connectable to a wellhead and arranged for gas flow therethrough, said motor valve having a pressure responsive valve therein adapted to close said motor valve in response to actuation pressure on said pressure responsive valve;

a pressure sensitive flow transmitter connectable to said motor valve downstream from a wellhead and arranged to communicate with pressure flow from the wellhead through said motor valve;

said transmitter having a two-way valve means therein for alternately applying and relieving actuation pressure to and from said pressure responsive valve;

actuation pressure conduit means connected to said two-way valve means and arranged to receive pressurized flow from the wellhead and transmit said flow to said valve means; and pressure regulation means in said actuation pressure conduit means adapted to maintain the pressure flowing therethrough at or below a predetermined maximum pressure level.

6. A well high pressure shutdown assembly for interconnecting between a wellhead and the well fluid flowline therefrom, said shutdown assembly comprising:

a pressure actuated, normally open, flow valve connectable in fluid communication with a well fluid outlet of a wellhead;

a spring biased piston and cylinder pressure sensing means connectable in fluid communication with said wellhead fluid conduit and operably connected to a slide valve means;

said slide valve means having one port in fluid communication with said flow valve, another port connectable in fluid communication with said wellhead fluid conduit downstream of said flow valve and having a vent port; said slide valve means said pressure sensor means being cooperatively operable to transmit fluid pressure to said flow valve while said wellhead fluid pressure remains within a predeterminable range of values and said slide valve means and said pressure sensor means being cooperatively operable to vent fluid pressure from said flow valve when wellhead fluid pressure is outside of the bounds of said predetermined range of values in order to close said normally open flow valve and thereby shutdown said well.

* * * * *

UNITED STATES PATENT OFFICE

CERTIFICATE OF CORRECTION

Patent No. 4,109,714 Dated August 29, 1978

Inventor(s) Donald Roy Greenlee & Milton Wayne Burns

It is certified that error appears in the above-identified patent and that said Letters Patent are hereby corrected as shown below:

Claim 6, line 39, insert --and-- after "means".

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*